US007855536B2

(12) United States Patent
Sumita

(10) Patent No.: US 7,855,536 B2
(45) Date of Patent: Dec. 21, 2010

(54) SEMICONDUCTOR INTEGRATED CIRCUIT DEVICE MINIMIZING THE TOTAL POWER OF BOTH THE POWER SUPPLY AND THE LOAD

(75) Inventor: Masaya Sumita, Hyogo (JP)

(73) Assignee: Panasonic Corporation, Osaka (JP)

( * ) Notice: Subject to any disclaimer, the term of this patent is extended or adjusted under 35 U.S.C. 154(b) by 350 days.

(21) Appl. No.: 11/646,606

(22) Filed: Dec. 28, 2006

(65) Prior Publication Data

US 2007/0177313 A1 Aug. 2, 2007

(30) Foreign Application Priority Data

Dec. 28, 2005 (JP) ..... 2005-379642
Dec. 27, 2006 (JP) ..... 2006-353054

(51) Int. Cl.
*G05F 1/565* (2006.01)

(52) U.S. Cl. ..... 323/275; 323/267; 323/281

(58) Field of Classification Search ..... 323/275, 323/303, 281, 266, 279, 299, 267
See application file for complete search history.

(56) References Cited

U.S. PATENT DOCUMENTS 6,141,762 A * 10/2000 Nicol et al. ..... 713/300
6,646,424 B2 * 11/2003 Zinn et al. ..... 323/268
6,771,052 B2 * 8/2004 Ostojic ..... 323/266
6,903,945 B2 6/2005 Kitano
6,967,522 B2 * 11/2005 Chandrakasan et al. ..... 327/534
7,353,410 B2 * 4/2008 Desai et al. ..... 713/300
7,581,122 B2 * 8/2009 Kim et al. ..... 713/300
2002/0158618 A1 10/2002 Hiraki et al.
2003/0065960 A1 * 4/2003 Rusu et al. ..... 713/300
2003/0234636 A1 12/2003 Ruan et al.
2004/0193929 A1 * 9/2004 Kuranuki ..... 713/322
2005/0162146 A1 7/2005 Kobayashi
2005/0219883 A1 * 10/2005 Maple et al. ..... 363/178

FOREIGN PATENT DOCUMENTS

JP 2005-197411 7/2005

OTHER PUBLICATIONS

Keshavarzi, et al., "Effectiveness of Reverse Body Bias for Leakage Control in Scaled Dual Vt CMOS ICs", ISLPED '01, Aug. 6-7, 2001, pp. 207-212, ACM.

* cited by examiner

*Primary Examiner*—Harry Behm
(74) *Attorney, Agent, or Firm*—McDermott Will & Emery LLP

(57) ABSTRACT

Source voltage and substrate voltage are supplied to a semiconductor integrated circuit 1E from the regulator circuits 11C and 21C of a power supply circuit 1C via a power detection compensating circuit 1D. The power efficiency value of a regulator is stored in the resistor file 13D, various detection information and power values are input to an operator 14D, the power values and the power efficiency values of the regulator circuits 11C and 21C are accumulated, and the power sum of a semiconductor integrated circuit 1E and a power supply circuit 1C are output. Minimum power implementation information corresponding to the various detection information of the semiconductor integrated circuit 1E is stored in an LUT 15D. Variable resistances R1*a* and R2*a* are controlled for determining the reference voltage values of the regulator circuits 11C and 21C so that the power sum is the minimum power value by comparing the minimum power implementation information with the output 14D.

9 Claims, 7 Drawing Sheets

SEMICONDUCTOR INTEGRATED CIRCUIT DEVICE MINIMIZING THE TOTAL POWER OF BOTH THE POWER SUPPLY AND THE LOAD

BACKGROUND OF THE INVENTION

1. Field of the Invention

The present invention relates to a technology for reducing the power consumption of an entire semiconductor integrated circuit device by supplying a proper voltage to a power supplied circuit in consideration of the power efficiency of a power supplied from a power supply circuit.

2. Description of the Related Art

In a semiconductor integrated circuit, as a plurality of insulating gate-type field effect transistor (hereinafter, abbreviated as 'MOSFET') is provided and the length of a channel and the thickness of a gate oxide film, it is possible to obtain high integration or the improvement in an operation speed by reducing the length of a channel and decreasing the thickness of a gate oxide film. However, since a threshold value decreases and a ratio of a leakage current in the power consumption amount increases, the countermeasures for the problems are required.

The power consumption is lowered by dynamically and variably controlling a voltage value supplied from the power supply circuit depending on the output of a processor or an SOC by a DVS (Dynamic Voltage Scaling) technology in the processor or the SOC (System On Chip) coupled to the semiconductor integrated circuit so as to suppress the leakage current.

It is well-known fact that the threshold value or the leakage current of the MOSFET can be controlled to some degree by adjusting a source-substrate voltage or a source-drain voltage. However, a recent research indicates that the leakage current increases due to a BTBT (Band To Band Tunneling) when the source-substrate voltage is equal to or less than a predetermined voltage (for example, see Patent Document 1).

Patent document 1 discloses the technology that the semiconductor integrated circuit controlled where the source of the MOSFET and the voltage of the substrate are controlled separately includes a monitor circuit constituted by a plurality of the MOSFETs, a leakage current detecting device for detecting the leakage current of the monitor circuit, and a substrate generating device, wherein the substrate voltage value of the semiconductor integrated circuit is varied to the substrate power source value which is a minimum data value detected by the monitor circuit in comparison with data output from the leakage current detecting device.

Patent Document 1: JP-A-2005-197411

Non-patent Document 1: pp207 to 211 of ISLPED'01, "Effectiveness of Reverse Body Bias for Leakage Control Scaled Dual Vt CMOS ICs" written by A. Keshavasrzi and seven others A source voltage value where the semiconductor integrated circuit' own power has the minimum value is required of the power supply circuit and is supplied to the semiconductor integrated circuit by the power supply circuit. However, the power may not have the minimum value in consideration of the total power of the semiconductor integrated circuit and the power supply circuit. The reason is that the power efficiency is different depending on the supply voltage and the supply voltage in consideration of the power efficiency (power source conversion efficiency) of the power supply circuit.

The power efficiency is approximately 25 to 50% when a regulator is used in the power supply circuit and the power efficiency is approximately 25 to 99% and very wide very wide when a DC-DC converter is used in the power supply circuit. That is, even if the power consumption of the semiconductor integrated circuit is set to the minimum value, the power supply circuit increases all the more when the power efficiency is low the total power of the semiconductor integrated circuit.

As a miniaturization process progresses, the drain-substrate leak current is more prominent than the source-drain leakage current due to the BTBT phenomenon. Accordingly, the power may not have the minimum value in consideration of the total power of the semiconductor integrated circuit and the power supply circuit even if the substrate voltage is applied so as to minimize the drain current of the semiconductor integrated circuit by the substrate voltage control technology disclosed in Patent Document 1. The reason is that the power efficiency of the power supply circuit (power efficiency to an output power supply voltage value) is different depending on the voltage value of the MOS substrate and the substrate current.

SUMMARY OF THE INVENTION

The present invention is finalized with a view to solving the problem. It is an object of the invention to provide the semiconductor integrated circuit capable of reducing the total power consumption of the power supplied circuit and the power supply circuit by determining the value of the voltage supplied from the power supply circuit in consideration of the power efficiency.

A semiconductor integrated circuit device according to the present invention includes a power supply circuit and compensates for a voltage supplied from the power supply circuit by using a power value supplied from the power supply circuit and a power source efficiency value of the power supply circuit. By this configuration, it becomes possible to reduce the power consumption of the semiconductor integrated circuit device in consideration of the power efficiency.

In the above-mentioned configuration, the power supply circuit may be the regulator-circuit. Accordingly, it is possible to miniaturize the semiconductor integrated circuit device. Accordingly, it is possible to easily reduce the cost and the power consumption when the power is supplied to the power source supplied circuit which does not consume much current.

In the above-mentioned configuration, the power supply circuit may be the DC-DC converter circuit. Accordingly, it is possible to deal with the supply of the power to the power supplied circuit having large current consumption amount.

In the above-mentioned configuration, the power value supplied from the power supply circuit may be detected by using the power supply line of the power supply circuit. Accordingly, it is possible to easily acquire the supplied power.

In the above-mentioned configuration, the power value supplied from the power supply circuit may be detected by using the control voltage of a first transistor of the power supply circuit for supplying a power to the power supply line of the power supply circuit. By this configuration, it is possible to easily acquire the supplied power without the voltage drop of the supply voltage.

In the above-mentioned configuration, the power value supplied from the power supply circuit may be detected by using a second inductance element disposed adjacent to a first inductance element inserted in the power supply line of the power supply circuit. Accordingly, it is possible to easily acquire the supplied power without the voltage drop of the supply voltage.

In the above-mentioned configuration, the power value supplied from the power supply circuit may be detected by using the voltage value of the power supply line of the power supply circuit and the resistance value inserted in the power supply line. Accordingly, it is possible to easily acquire the supplied power.

In the above-mentioned configuration, the power value supplied from the power supply circuit may be detected by using a current flowing between the source and the drain of the second transistor. Accordingly, it is possible to easily acquire the supplied power without the voltage drop of the supply voltage.

In the above-mentioned configuration, the power value supplied from the power supply circuit may be detected by using the value of a current flowing on the second inductance element. Accordingly, it is possible to acquire the supplied power without the voltage drop of the supplied voltage.

In the above-mentioned configuration, the power value supplied from the power supply circuit may be used by converting the voltage value of the power supply line to a digital value. Accordingly, it becomes possible to transfer data to a digital circuit constituted by MOS, thereby miniaturizing the semiconductor integrated circuit device.

In the above-mentioned configuration, the power value supplied from the power supply circuit may be used by converting the value of the current flowing between the source and the drain of the second transistor to the digital value. Accordingly, it becomes possible to transfer the data to the digital circuit constituted by the MOS, thereby miniaturizing the semiconductor integrated circuit device.

In the above-mentioned configuration, the power value supplied from the power supply circuit may be used by converting the value of the current flowing on the second inductance element to the digital value. Accordingly, it becomes possible to transfer the data to the digital circuit constituted by the MOS, thereby miniaturizing the semiconductor integrated circuit device.

In the above-mentioned configuration, the power value supplied from the power supply circuit may be used by converting the value of the current flowing between the source and the drain of the second transistor to the voltage value. Accordingly, since it becomes possible to transfer the data to an analog circuit, it may be unnecessary to manufacture the element of the MOS device when the power supplied circuit is consisted of only bipolar transistors. Therefore, it is possible to reduce the cost of the semiconductor integrated circuit device.

In the above-mentioned configuration, the power value supplied from the power supply circuit may be used by converting the value of the current flowing on the second inductance element to the voltage value. Accordingly, since it becomes possible to transfer the data to the analogue circuit, it may be unnecessary to manufacture the element of the MOS when the power supplied circuit is bipolar. Therefore, it is possible to reduce the cost of the semiconductor integrated circuit device.

In the above-mentioned configuration, the power value supplied from the power supply circuit may be used by converting the voltage value of the power supply line to a frequency. Accordingly, since it becomes possible to transfer the data to the analogue circuit, it may be unnecessary to manufacture the element of the MOS when the power supplied circuit is bipolar. Therefore, it is possible to reduce the cost of the semiconductor integrated circuit device.

In the above-mentioned configuration, the power value supplied from the power supply circuit may be used by converting the value of the current flowing between the source and the drain of the second transistor to the frequency. Accordingly, since it becomes possible to transfer the data to the analogue circuit, it may be unnecessary to manufacture the element of the MOS when the power supplied circuit is bipolar. Therefore, it is possible to reduce the cost of the semiconductor integrated circuit device.

In the above-mentioned configuration, the power value supplied from the power supply circuit may be used by converting the value of the current flowing on the second inductance element to the frequency. Accordingly, since it becomes possible to transfer the data to the analogue circuit, it may be unnecessary to manufacture the element of the MOS when the power supplied circuit is bipolar. Therefore, it is possible to reduce the cost of the semiconductor integrated circuit device.

In the above-mentioned configuration, there may be provided a function of mixing the power source efficiency of the power supply circuit with the power supplied from the power supply circuit. Accordingly, it is possible to consider the power source efficiency with respect to the supplied power.

In the above-mentioned configuration, there may be provided an operator having a function of accumulating the power source efficiency of the power supply circuit to the power value supplied from the power supply circuit. Accordingly, it is possible to accumulate the power source efficiency with respect to the supplied power.

In the above-mentioned configuration, there may be provided a resistor storing the power source efficiency value in response to the output power value of the power supply circuit. Accordingly, it is possible to store each power source efficiency value of the supplied power, thereby outputting the required power source efficiency value at high speed.

In the above-mentioned configuration, there may be provided a multiplier for multiplying the value of the resistor which stores the power source efficiency value in response to the power value supplied from the power supply circuit and the output power value of the power supply circuit. Accordingly, it is possible to accumulate the power source efficiency value of the supplied power at high speed, thereby outputting the result.

In the above-mentioned configuration, there may be provided an LUT for outputting the information of the output power value of the power supply circuit where the output value of the operator has the minimum value. Accordingly, it is possible to determine the minimum voltage value in consideration of the power source efficiency at high speed.

In the above-mentioned configuration, there may be provided search function means for sequentially compensating for the output voltage value of the power supply circuit so that the output value of the operator has the minimum value. Accordingly, it is possible to obtain the minimum voltage value by a small area in consideration of the power efficiency.

In the above-mentioned configuration, the search function means roughly may compensate for the output value of the operator in a first step and minutely compensate for the accuracy of the output value of the operator in a second step. Accordingly, since the configuration can be implemented by a smaller area than at the time of using the LUT, it is possible to optimize each supply voltage in consideration of the power efficiency. Finally, it becomes possible that the entire semiconductor integrated device has low power consumption in high precision.

In the above-mentioned configuration, the value of the voltage supplied from the power supply circuit may include an upper limit value and a lower limit value. Accordingly, it is possible to prevent excessively low voltage or excessively low voltage from being applied to the power supplied circuit beforehand.

In the above-mentioned configuration, the upper limit value and the lower limit value may be determined by information provided from the power supplied circuit. Accordingly, it is possible to prevent the excessively small voltage or the excessively small voltage from being applied to the semiconductor integrated circuit of a power supply destination in high precision beforehand.

In the above-mentioned configuration, there may be provided accumulating means for accumulating values acquired by mixing the powers supplied from the plurality of outputs of the power supply circuit with the power source efficiencies of the plurality of outputs of the power supply circuit, wherein the power supply circuit has the plurality of outputs of the power supply circuit. Accordingly, it is possible to optimize each voltage value supplied to the power supplied circuit, thereby reducing the power consumption of the semiconductor integrated circuit device in high precision.

In the above-mentioned configuration, the means for compensating for the voltage supplied from the power supply circuit may adjust the reference current source of the regulator. Accordingly, it is possible to compensate for the voltage having excellent power efficiency.

In the above-mentioned configuration, the means for compensating for the voltage supplied from the power supply circuit may adjust the reference voltage source of the regulator. Accordingly, it is possible to use the known reference voltage, thereby compensating for the voltage by the small area.

In the above-mentioned configuration, the means for compensating for the voltage supplied from the power supply circuit may adjust the element characteristic of an LC portion in the DC-DC converter. Accordingly, the flexibility of a voltage compensation range is improved, thereby compensating for the voltage having more excellent power efficiency.

In the above-mentioned configuration, the means for compensating for the voltage supplied from the power supply circuit may adjust an input frequency of reference voltage source of the regulator. Accordingly, it is possible to use the known oscillator, thereby compensating for the voltage by the small area.

In the above-mentioned configuration, the power supply destination of the power supply circuit may be the semiconductor integrated circuit. Accordingly, it becomes possible to reduce the power sum of the power supply circuit and the semiconductor integrated circuit.

In the above-mentioned configuration, the power supply destination of the power supply circuit may be the semiconductor integrated circuit. Accordingly, it becomes possible to reduce the power sum of the power supply circuit and the semiconductor integrated circuit when the semiconductor integrated circuit is controlled by a DVS technique.

In the above-mentioned configuration, the semiconductor integrated circuit device may be used for one of a communication apparatus, an information reproducing apparatus, an image display apparatus, an electronic apparatus, and an electronic control apparatus. Accordingly, it becomes possible to apply the semiconductor integrated circuit to various fields.

In the above-mentioned configuration, the power supply destination of the power supply circuit may be the substrate voltage of the semiconductor integrated circuit. Accordingly, it becomes possible to reduce the power sum of the power supply circuit and the semiconductor integrated circuit when a substrate control is performed for the semiconductor integrated circuit.

In the above-mentioned configuration, the power supply destination of the power supply circuit may be the substrate voltage of the semiconductor integrated circuit. Accordingly, it becomes possible to reduce the power sum of the power supply circuit and the semiconductor integrated circuit when the DVS control and the substrate control are performed for the semiconductor integrated circuit.

In the above-mentioned configuration, the means for compensating for the voltage supplied from the power supply circuit may control the voltage supplied from the power supply circuit so that values acquired by multiplying the power source efficiencies of the plurality of outputs of the power supply circuit by the powers supplied from the plurality of outputs of the power supply circuit are minimum values. Accordingly, it becomes possible to reduce the power sum of the power supply circuit and the power supplied circuits.

In the above-mentioned configuration, the means for compensating for the voltage supplied from the power supply circuit may sequentially select one of the outputs of the power supply circuit, fix supply voltages of outputs other than the selected output, repeat an operation of varying the supply voltages of the selected output from the minimum voltage to the maximum voltage, and control the voltages supplied from the power supply circuit so that the values acquired by multiplying the power source efficiencies of the plurality of outputs of the power supply circuit by the powers supplied from the plurality of outputs of the power supply circuit are the minimum values. Accordingly, it becomes possible to obtain the minimum value of the power sum of the power supply circuit and the semiconductor integrated circuit by the small area.

In the above-mentioned configuration, the compensation of the supply voltage may start at the time of a standby transition of the semiconductor integrated circuit. Accordingly, since the means for compensating for the supply voltage from the power supplied circuit only when it is necessary to reduce the power of the power supplied circuit, it becomes possible to reduce the power sum of the power supply circuit and the semiconductor integrated circuit in temporal sequence.

In the above-mentioned configuration, the compensation of the supply voltage may start at the time of a stop transition of the semiconductor integrated circuit. Accordingly, since the means for compensating for the supply voltage from the power supplied circuit only when it is necessary to reduce the power of the power supplied circuit, it becomes possible to reduce the power sum of the power supply circuit and the semiconductor integrated circuit in temporal sequence.

In the above-mentioned configuration, the compensation of the supply voltage may start at the time when an operation frequency of the semiconductor integrated circuit device is varied. Accordingly, since the means for compensating for the supply voltage from the power supplied circuit only when it is necessary to reduce the power of the power supplied circuit, it becomes possible to reduce the power sum of the power supply circuit and the semiconductor integrated circuit in temporal sequence.

In the above-mentioned configuration, the compensation of the supply voltage may start at the time when an activation rate of the semiconductor integrated circuit device is varied. Accordingly, since the means for compensating for the supply voltage from the power supplied circuit only when it is necessary to reduce the power of the power supplied circuit, it becomes possible to reduce the power sum of the power supply circuit and the semiconductor integrated circuit in temporal sequence.

In the above-mentioned configuration, the compensation of the supply voltage may start at the time when a voltage value of the semiconductor integrated circuit device is varied. Accordingly, since the means for compensating for the supply voltage from the power supplied circuit only when it is necessary to reduce the power of the power supplied circuit, it becomes possible to reduce the power sum of the power supply circuit and the semiconductor integrated circuit in temporal sequence.

In the above-mentioned configuration, the compensation of the supply voltage may start at the time when a temperature of the semiconductor integrated circuit device is varied. Accordingly, since the means for compensating for the supply voltage from the power supplied circuit only when it is necessary to reduce the power of the power supplied circuit, it becomes possible to reduce the power sum of the power supply circuit and the semiconductor integrated circuit in temporal sequence.

In the above-mentioned configuration, the voltage value detecting circuit may be connected to a near end and a far end of the power supply circuit on the power supply line. Accordingly, it becomes possible to detect consumed current by the difference of the voltage value.

In the above-mentioned configuration, the operator may be positioned in the power supply circuit. Accordingly, it becomes possible to reduce the power of the power supply circuit all the more.

In the above-mentioned configuration, a value stored in the resistor file may include information of the power source efficiency value in response to the temperature of the power supply circuit. Accordingly, it becomes possible to output the power efficiency value of the power supply circuit in higher precision, thereby reducing the power of the semiconductor integrated circuit device all the more.

In the above-mentioned configuration, the value stored in the resistor file may include information of the power source efficiency value in response to the manufacturing process result of the power supply circuit. Accordingly, it becomes possible to output the power efficiency value of the power supply circuit in higher precision, thereby reducing the power of the semiconductor integrated circuit device all the more.

In the above-mentioned configuration, the lower limit value of the voltage value supplied from the power supply circuit may be determined by software error detection information generated from the semiconductor integrated circuit of the power supply destination in the power supply circuit. Accordingly, it becomes possible to prevent the malfunction of the semiconductor integrated circuit from occurring beforehand, thereby reducing the power of the semiconductor integrated circuit device in higher precision.

In the above-mentioned configuration, the lower limit value of the voltage value supplied from the power supply circuit may be determined by noise margin detection information generated from the semiconductor integrated circuit of the power supply destination in the power supply circuit. Accordingly, it becomes possible to prevent the malfunction of the semiconductor integrated circuit from occurring beforehand, thereby reducing the power of the semiconductor integrated circuit device in higher precision.

In the above-mentioned configuration, the lower limit value of the voltage value supplied from the power supply circuit may be determined by temperature detection information generated from the semiconductor integrated circuit of the power supply destination in the power supply circuit. Accordingly, it becomes possible to prevent the malfunction of the semiconductor integrated circuit from occurring beforehand, thereby reducing the power of the semiconductor integrated circuit device in higher precision.

In the above-mentioned configuration, the lower limit value of the voltage value supplied from the power supply circuit may be determined by malfunction detection information generated from the semiconductor integrated circuit of the power supply destination in the power supply circuit. Accordingly, it becomes possible to prevent the malfunction of the semiconductor integrated circuit from occurring beforehand, thereby reducing the power of the semiconductor integrated circuit device in higher precision.

In the above-mentioned configuration, the upper limit value of the voltage value supplied from the power supply circuit may be determined by transistor withstand voltage detection information generated from the semiconductor integrated circuit of the power supply destination in the power supply circuit. Accordingly, it becomes possible to prevent the destruction of the semiconductor integrated circuit from occurring beforehand, thereby reducing the power of the semiconductor integrated circuit device in higher precision.

In the above-mentioned configuration, the upper limit value of the voltage value supplied from the power supply circuit may be determined by crosstalk detection information generated in the semiconductor integrated circuit of the power supply destination in the power supply circuit. Accordingly, it becomes possible to prevent the malfunction of the semiconductor integrated circuit from occurring beforehand, thereby reducing the power of the semiconductor integrated circuit device in higher precision.

In the above-mentioned configuration, the upper limit of the voltage value supplied from the power supply circuit value may be determined by temperature detection information generated from the semiconductor integrated circuit of the power supply destination in the power supply circuit. Accordingly, it becomes possible to reduce the power of the semiconductor integrated circuit device in higher precision.

In the above-mentioned configuration, the upper limit value of the voltage value supplied from the power supply circuit may be determined by latch-up detection information generated from the semiconductor integrated circuit of the power supply destination in the power supply circuit. Accordingly, it becomes possible to prevent the overcurrent of the semiconductor integrated circuit from occurring beforehand, thereby reducing the power of the semiconductor integrated circuit device in higher precision.

In the above-mentioned configuration, the lower limit value of the voltage value supplied from the power supply circuit may be determined by deterioration detection information generated from the semiconductor integrated circuit of the power supply destination in the power supply circuit. Accordingly, it becomes possible to prevent the deterioration of the semiconductor integrated circuit from occurring beforehand, thereby reducing the power of the semiconductor integrated circuit device in higher precision.

In the present invention, it becomes possible to reduce the power consumption of an entire semiconductor integrated circuit device even when the semiconductor integrated circuit of a power supply destination controls a voltage so as to reduce the power consumption of the entire semiconductor integrated circuit device by supplying a proper voltage to a power supplied circuit in consideration of the power efficiency of a power supplied from a power supply circuit.

DESCRIPTION OF THE PREFERRED EMBODIMENTS

Hereinafter, embodiments of the present invention will be described with reference to the drawings.

First Embodiment

Figure 1:
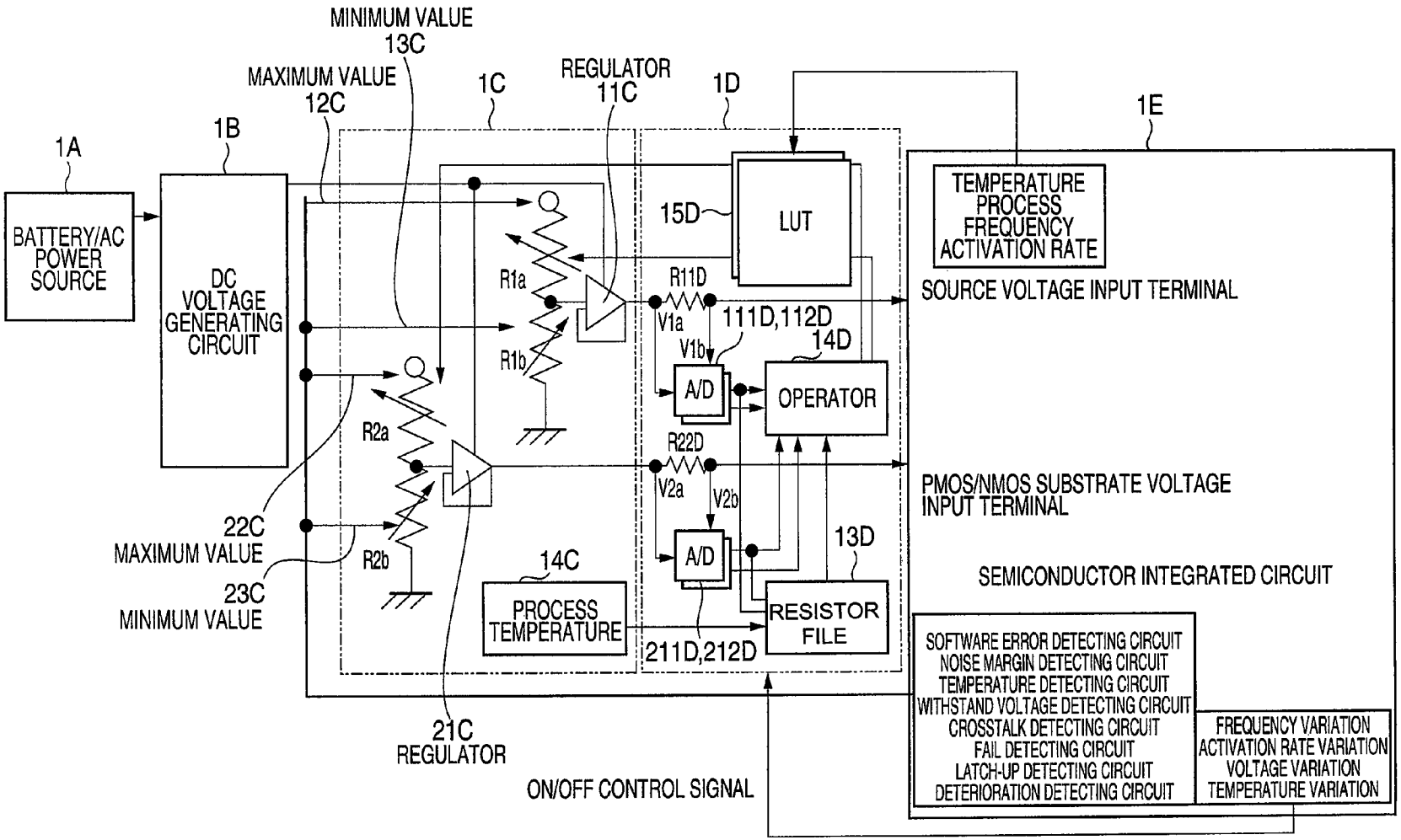
FIG. 1 is a block diagram showing the configuration of a semiconductor integrated circuit device according to a first embodiment of the invention.

FIG. 1 is a block diagram showing the configuration of a semiconductor integrated circuit according to a first embodiment of the invention. In FIG. 1, a power source is supplied from a battery or an AC power source 1A, the power source is rectified to a DC voltage in a DC voltage generating circuit 1B, and the voltage is supplied to the semiconductor integrated circuit 1E which is the power supplied circuit through a power supply circuit 1C and a power detection compensating circuit 1D.

A power supply circuit 1C includes two regulator circuits 11C and 21C therein. Typically, the DC voltage generating circuit 1B and the power supply circuit 1C are made into one chip as a set. However, herein, the DC voltage generating circuit 1B and the power supply circuit 1C is divided into two for convenience of description.

The source voltage and the substrate voltage of a PMOS or an NMOS are supplied to the semiconductor integrated circuit 1E which the power supplied circuit from the power supply circuit 1C. In this case, the source voltage is supplied from the regulator circuit 11C and the substrate voltage of the PMOS is supplied from the regulator circuit 21C.

The regulator circuit 11C supplies the voltage to the semiconductor integrated circuit 1E so as to be the same voltage value as a reference voltage by setting a potential obtained by dividing a maximum value 12C to a ground into resistances R1*a* and R1*b* to the reference voltage.

The maximum 12C is set to a maximum allowable voltage value determined by a crosstalk detecting circuit for detecting a malfunction by a signal line interference, a withstand voltage detecting circuit for detecting the gate withstand voltage of the transistor, and a temperature detecting circuit for dynamically detecting a temperature in the semiconductor integrated circuit involved in a detecting circuit group inside the semiconductor integrated circuit 1E.

The detecting circuit group may be other than the circuits and may not have all the circuits described above. The key point is that the maximum 12C is the voltage value for preventing the malfunction or the destruction from occurring in the semiconductor integrated circuit 1E due to an excess voltage.

Reference numeral R1*b* is the variable resistance and the resistance value is controlled so that the reference voltage is not less than the minimum voltage value. The resistance value is determined a software error detecting circuit for detecting a software error caused by radiation, a noise margin detecting circuit for detecting a DC noise margin such as an SRAM, a domino circuit, or a CMOS circuit, a fail detecting circuit for detecting the malfunction of the integrated circuit at a low voltage, and a temperature detecting circuit involved in the detecting circuit group inside the semiconductor integrated circuit 1E.

The key point is that the minimum voltage value is the voltage value for preventing the malfunction from occurring in the semiconductor integrated circuit 1E due to an excessively low voltage. Reference numeral R1*b* may not be the variable resistance when the maximum voltage and the minimum voltage of the semiconductor integrated circuit 1E are previously known.

The regulator circuit 21C supplies the substrate voltage to the semiconductor integrated circuit 1E so that the reference voltage is the same as the reference voltage by setting the potential obtained by dividing a maximum value 22C to the ground into resistances R2*a* and R2*b* to the reference voltage.

The maximum value 22C is set to the maximum allowable voltage value determined by a deterioration detecting circuit for detecting an aged deterioration in the detecting circuit inside the semiconductor integrated circuit 1E.

The detecting circuit may be other than the circuit and may not have all the circuits described above.

The key point is that the maximum 22C is the voltage value for preventing an excessive deterioration from occurring in the semiconductor integrated circuit 1E due to the excessively high voltage.

Reference numeral R2*b* is the variable resistance and the resistance value is controlled so that the reference voltage is not less than the minimum voltage value.

The resistance value is determined a latch-up detecting circuit for detecting an excess current caused by a parasitic bipolar in the semiconductor integrated circuit.

The key point is that the minimum voltage value is the voltage value for preventing the excess current from flowing in the semiconductor integrated circuit. Reference numeral R2*b* may not be the variable resistance when the maximum voltage and the minimum voltage of the semiconductor integrated circuit 1E are previously known.

Herein, the maximum voltage value and the minimum voltage value applied to the substrate voltage will be described with reference to the values of the PMOS.

The detecting circuit for determining the maximum voltage value and the minimum voltage value is connected adversely in the NMOS. The potential obtained by dividing the maximum value 22C to a negative voltage into the resistances R2*a* and R2*b* is set to the reference voltage when the substrate voltage of the NMOS is supplied.

Reference numeral 1D represents a power detection compensating circuit. The power detection compensating circuit compensates for the supply voltage of the power supply circuit 1C in consideration of the power efficiency of the power supply circuit 1C by detecting the power of the power supply circuit 1C.

A resistance R11D is serially inserted in a wiring to the source voltage input terminal of the semiconductor integrated circuit 1E from the regulator circuit 11C and both ends of the resistance R11D are connected to A/D converters 111D and 112D, in the power detection compensating circuit 1D. A resistance R21D is serially inserted in the wiring to the source voltage input terminal of the semiconductor integrated circuit 1E from the regulator circuit 21C and both ends of the resistance R21D are connected to A/D converters 211D and 212D.

The power detection compensating circuit 1D includes a resistor file 13D therein. The power efficiency value of the regulator is stored in the resistor file 13D. Process result information in the power supply circuit 1C, temperature information, and the output values of the A/D converters 111D, 112D, 211D, and 212D are input in an address value therein and the power efficiency values of the regulator circuits 11C and 21C are output therefrom.

The output values of the A/D converters 111D, 112D, 211D, and 212D and the output values of the resistor file 13D are input in the power detection compensating circuit ID. An operator 14D having a mixer function mixing the power value and the power efficiency value is disposed therein.

They may be either CMOS or Bipolar. The key point is that mixing of the power supply circuits is easily performed, thereby obtaining the reduction in power consumption and cost. They may be realized by separate chips outside the power supply circuit and may be provided in the semiconductor integrated circuit 1E.

The power value and power efficiencies $\alpha$1 and $\alpha$2 from the regulator circuits 11C and 21C are accumulated by the operator 14D. The counted values are output. That is, the operator 14D outputs the power sum of the semiconductor integrated circuit 1E and the power supply circuit 1C.

The power is represented as shown in Expression 1 as The power the self power of the power supply circuit 1C is represented as W0, the voltages of the input and output terminal of the resistance R11D are represented as V1*a* and V1*b*, and the voltages of the input and output terminals of the resistance R22D are represented as V2*a* and V2*b*.

$$W0+V1b(V1a-V1b)/R11D/\alpha1+V2b(V2a-V2b)/R22D/\alpha2 \quad \text{(Expression 1)}$$

An LUT 15D is disposed in the power detection compensating circuit 1D. Information required for obtaining the minimum power, which corresponds to the temperature, process result, frequency, and activation rate information of the semiconductor integrated circuit 1E, is stored in the LUT 15D.

The variable resistances R1*a* and R2*a* are controlled for determining the reference voltage values of the regulator circuits 11C and 21C so that the supply voltage value is the minimum power value by comparing the current value of Expression 1 acquired by the operator 14D with the information.

When the self power W11*c*0 of the regulator circuit 11C and the self power W21*c*0 of the regulator circuit 21C are separately considered, the power sums of the self powers W11*c*0 and W21*c*0 are shown in Expressions 2 and 3, respectively. The regulator circuits 11C and 21C may be separately controlled by inputting the outputs to the LUT.

$$W11c0+V1b(V1a+V1b)/R11D/\alpha1 \quad \text{(Expression 2)}$$

$$W21c0+V2b(V2a+V2b)/R22D/\alpha2 \quad \text{(Expression 3)}$$

As described above, it becomes possible to obtain not the low power consumption only in the semiconductor integrated circuit 1E in the past, but to reduce the power consumption of the entire semiconductor integrated circuit device by supplying a proper voltage to the power supplied circuit in consideration of the power efficiency of the power supplied from the power supply circuit 1C in a voltage range where the malfunction or the destruction of the semiconductor integrated circuit 1E which is the power source supplied circuit does not occur.

The power detection compensating circuit 1D may not always operate. The power detection compensating circuit 1D starts only when the mode transition of the semiconductor integrated circuit 1E such as the transition to a standby mode (when an operating frequency is 0 and a voltage is supplied) from a typical operation and the return from a stop mode (when the operating frequency is 0 and the voltage is not supplied), the frequency is intentionally varied, the activation rate is intentionally varied (at the time of the conversion of an application when a multi-thread technology is used with a processor), the power source voltage and the substrate voltage are intentionally varied, and the temperature is varied. Then, when the power supply circuit 1C is set to the optimum value, the power detection compensating circuit 1D. Therefore, it is possible to reduce the power consumption in temporal sequence all the more.

Second Embodiment

Figure 2:
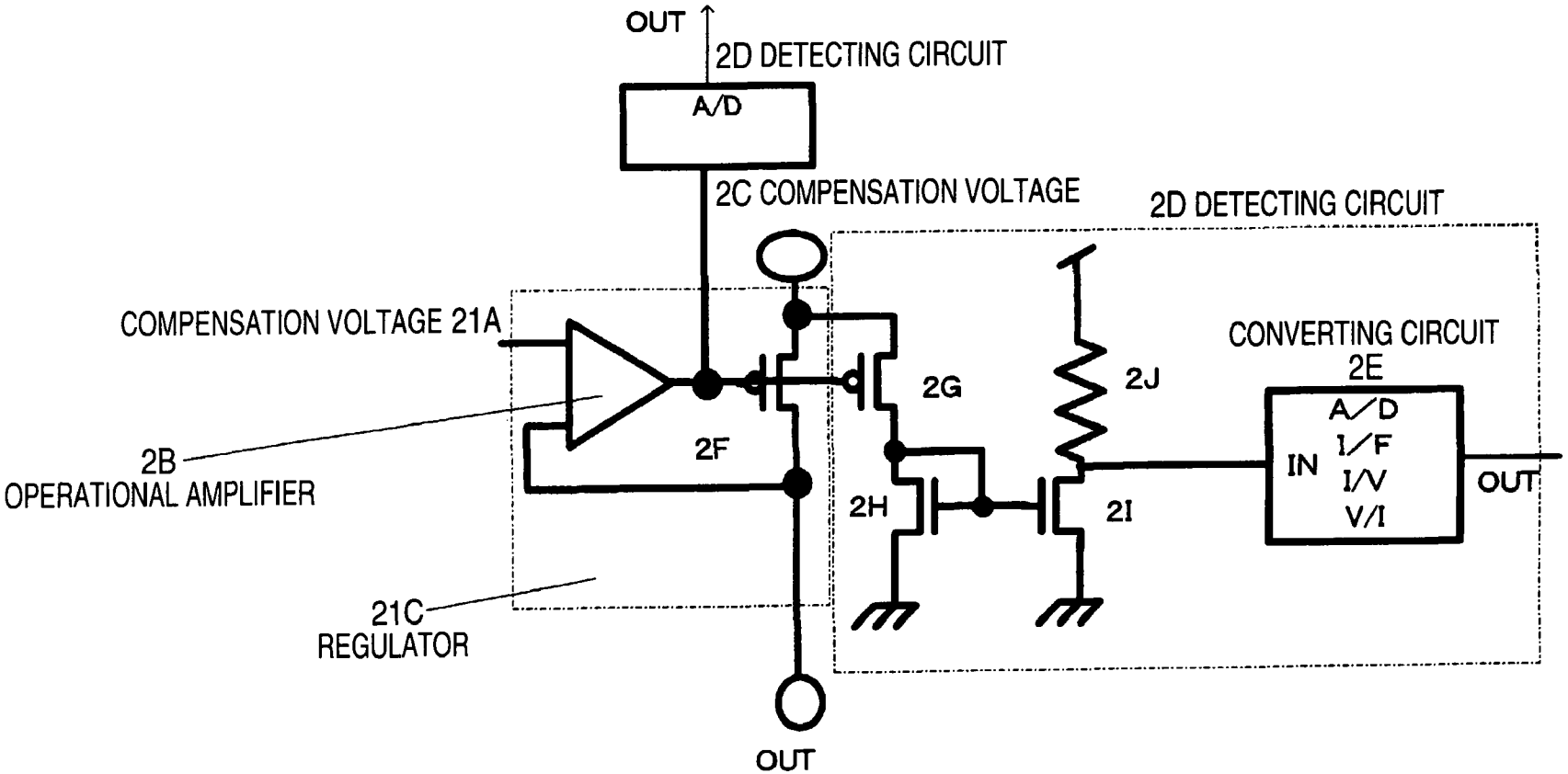
FIG. 2 is a block diagram showing the configuration of a power supply circuit in a semiconductor integrated circuit device according to a second embodiment of the invention.

FIG. 2 is a block diagram showing the configuration of a power supply circuit in a semiconductor integrated circuit device according to a second embodiment of the invention. The present embodiment shows a method different from the implementation method of the first embodiment with respect to the power detection and the optimal voltage value setting by the regulator circuit and the power detection compensating circuit. The regulator circuit according to the present embodiment is a mode in which the miniaturization and the low cost are easily implemented when the power is supplied to the power source supplied circuit which does not consume much current.

In FIG. 2, a regulator 21 is provided with an operational amplifier 2B and a PMOS 2F. The output of the operational amplifier 2B controls the gate voltage of the PMOS 2*f* so that a voltage value input from a compensation voltage value 21A and output from the drain of the PMOS 2F is the reference voltage value with respect to the reference voltage of the operational amplifier 2B. Since the reference voltage input terminal of the known operational amplifier 2B can be intactly used, it is possible to implement the miniaturization.

The compensation voltage value 2C is input to the source of the PMOS 2F, i.e. a current source. The PMOS 2F itself has a resistance property. Accordingly, it is possible to perform the compensation with a higher power efficiency by decreasing the compensation voltage value 2C when the voltage value between the source and the drain of the PMOS 2F is large. Therefore, it is possible to obtain the effect that the power efficiency of the regulator circuit 21C increases.

A detecting circuit 2D is provided with a PMOS 2G, an NMOS 2H, an NMOS 21, a resistance 2J, and a converting circuit 2E. A signal line controlling the gate voltage of the PMOS 2F is connected to the PMOS 2G and the amount of the current flowing on the drain of the PMOS 2G is input to the converting circuit 2E via the NMOS 2H and the NMOS 21.

The current is converted to a frequency in response to the current value (I/F conversion) or the current is converted to a voltage value in response to the current value (I/V conversion) in the converting circuit 2E. After the current is once converted to the voltage value, the current may be converted to the current value in an optimal range where the operator can be used. Alternatively, the resistance 2J is connected to the drain of the NMOS 21 and the junction is input to the converting circuit 2E and is converted to a digital value by the A/D converter.

As another arrangement connection method of the detecting circuit, the input terminal of another detecting circuit 2D is connected to the signal line controlling the gate voltage of the PMOS 2F and the voltage value may be converted to the digital value by the A/D converter.

In the arrangement connection method of the detecting circuit 2D described in the configuration, since the detecting circuit 2D is not connected directly to the output portion of the regulator circuit, it is possible to prevent the voltage drop of a supply line due to the insertion of a resistance element.

The present embodiment illustrates an example configured by the MOS. However, the detecting circuit can be configured by a bipolar element or a FET element in the same manner. Several examples are described for the converting circuit. However, it is possible to reduce the area and the cost of the regulator circuit by configuring an element the most preferable for a process for forming the regulator circuit.

Third Embodiment

Figure 3:
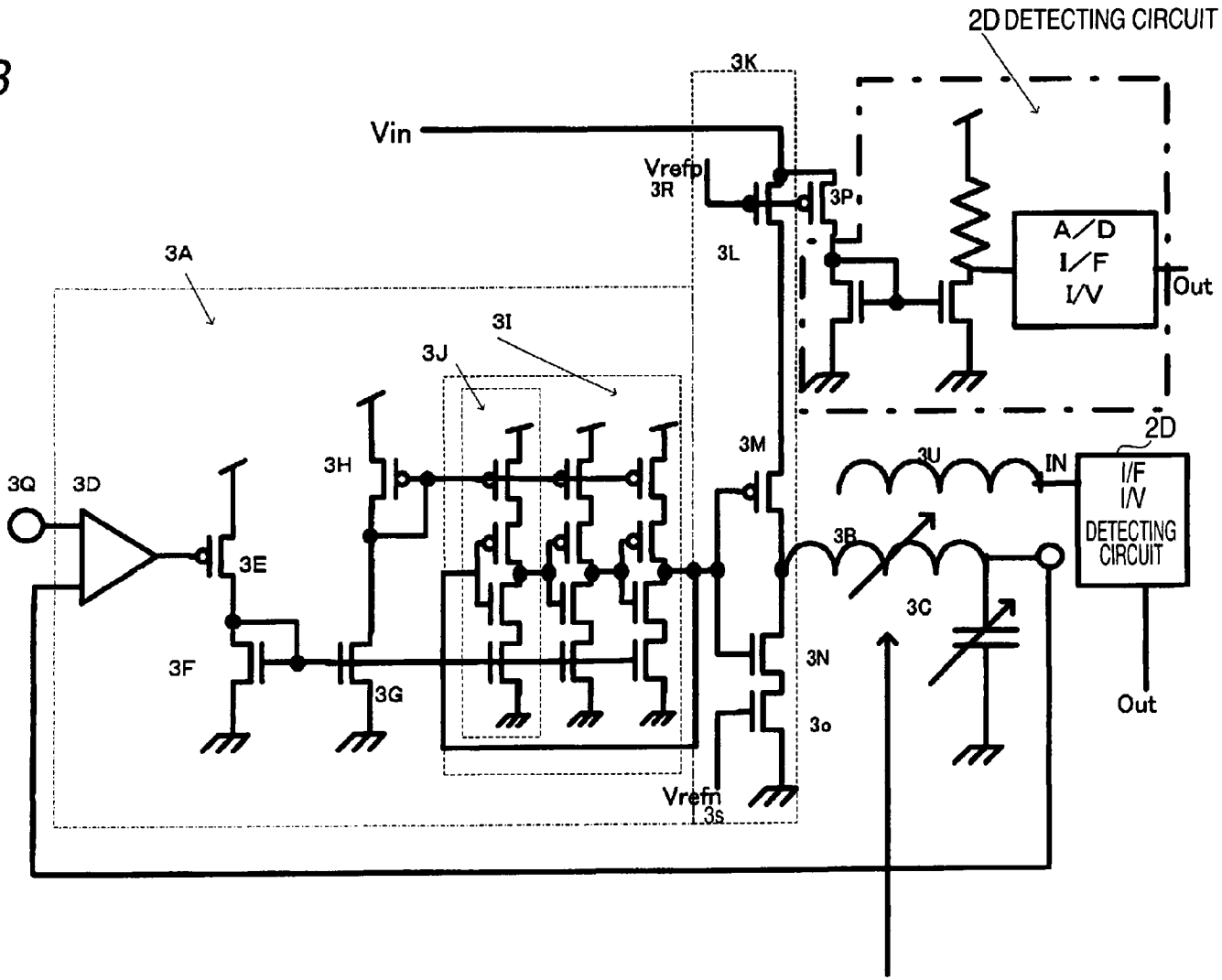
FIG. 3 is a block diagram showing the configuration of a power supply circuit in a semiconductor integrated circuit device according to a third embodiment of the invention.

FIG. 3 is a block diagram showing the configuration of a power supply circuit in a semiconductor integrated circuit device according to a third embodiment of the invention. In the present embodiment, the regulator circuit of the first embodiment is substituted for the DC-DC converter. The DC-DC converter is the effective mode when the power supplied circuit consumes large current.

In FIG. 3, a PWM 3A inputs one compensation voltage output from the power detection compensating circuit 1D to a compensation voltage 3Q and comparing the voltage value with the output value 3T of the DC-DC converter. The PWA 3A variably controls the frequency of a voltage control oscillator 3I so that both values are the same.

Specifically, one of the compensation outputs from the power detection compensating circuit 1D is input to the operational amplifier 3D as the compensation voltage 3Q, the output value 3T of the DC-DC converter is input to the operational amplifier 3D, and the output from the operational amplifier 3D is transmitted to a delay variable inverter 3*j* constituting the voltage control oscillator 3I via a PMOS 3E, a NMOS 3F, an NMOS 3G, and a PMOS 3H. Therefore, the PWM 3A controls the current ability.

The output of the PWM 3A is input to a switch circuit 3K. The switch circuit 3K is provided with a PMOS 3L, a PMOS 3M, an NMOS 3N, and an NMOS 3O. In the gate voltage of the PMOS 3L, the current value is controlled by inputting one of the compensation voltage outputs from the power detection compensating circuit 1D to Vrefp3R. In the gate voltage of the NMOS 3O, the current value is controlled by inputting one of the compensation voltage outputs from the power detection compensating circuit 1D to Vrefn3S.

The output from the drain junction of the PMOS 3M and the NMOS 3N in the switch circuit 3K is connected to one end of a variable inductance 3B controlled by the output from the power detection compensating circuit 1D and the junction of the other end of the variable inductance 3B and a variable condenser 3C becomes the output 3T of the DC-DC converter.

As described above, it is possible to increase the power efficiency of the DC-DC converter by connecting the compensation voltage output from the power detection compensating circuit 1D to various locations. That is, it is possible to reduce the power consumption by improving a flexibility optimized so that a power consumed by the voltage control oscillator 3I, a power consumed by the resistance of the PMOS 3L, and an electromotive force by the variable inductance 3B and the variable condenser 3C have the minimum values.

In the detecting circuit 2D, the drain of the PMOS 3P disposed parallel to the PMOS 3L is set as an input. Current flowing on the drain is converted to the frequency (I/F) or converted to the voltage (I/V), which is output. The resistance is connected to the drain the PMOS 3P and is converted to the digital value by the A/D converter of the detecting circuit 2D.

In the detecting circuit 2D, one end of an inductance 3U having the interaction with the variable inductance 3B may be input. In this case, current flowing on the inductance 3U is converted to the frequency or the voltage, which is output.

By this configuration, since the detecting circuit 2D is not connected to the output portion of the DC-DC converter, it is possible to prevent the voltage drop of the supply line due to the insertion of the resistance element.

It is possible to reduce the area and the cost of the DC-DC converter by configuring the converting circuit with an element the most preferable for a process for forming the DC-DC converter. For example, a digital conversion is preferable in a manufacturing process using the MOS and it is preferable to configure the operator of a current conversion or a frequency conversion in an analogue mode in the bipolar process.

Fourth Embodiment

Figure 4:
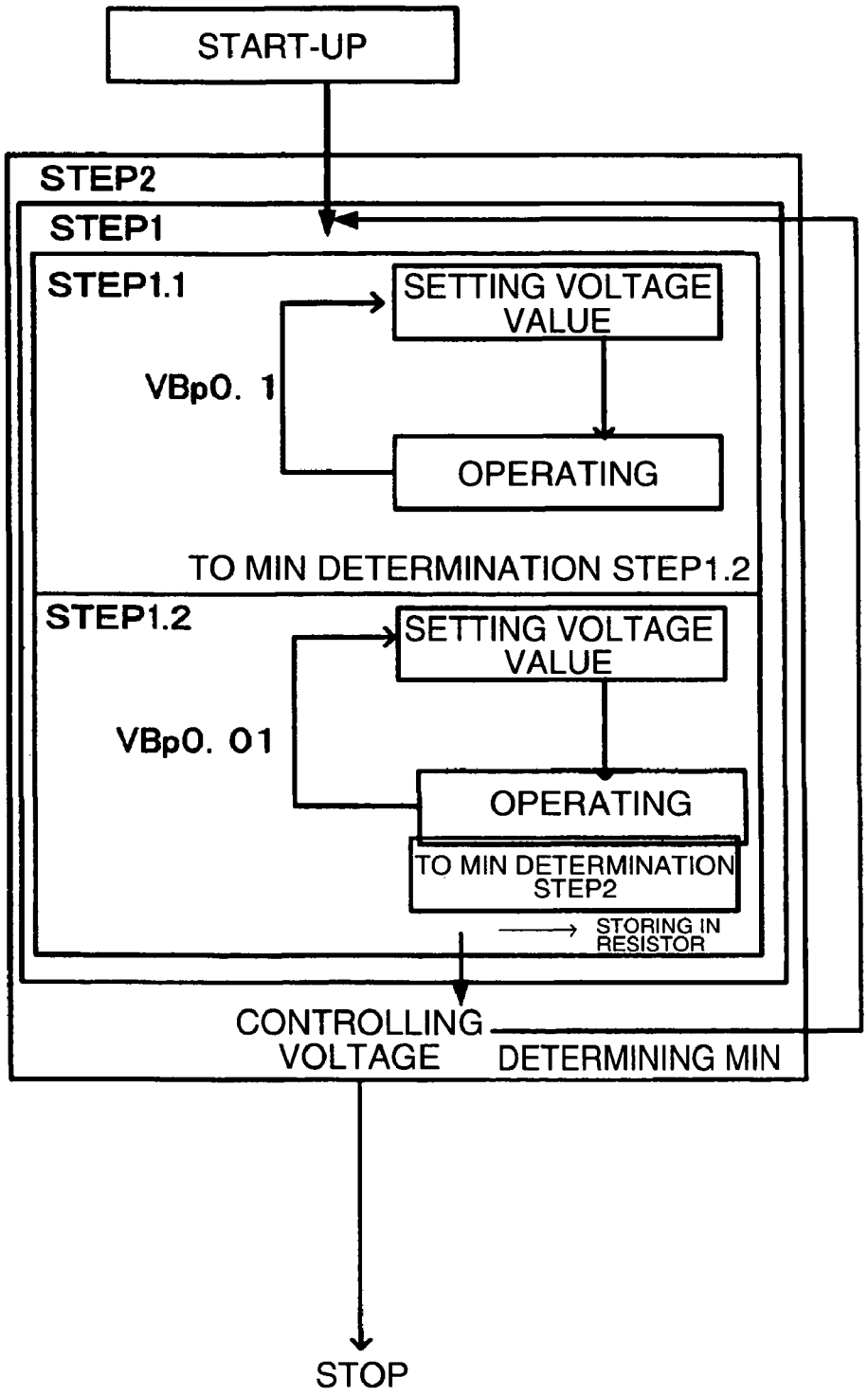
FIG. 4 is a flowchart showing an optimization search function in a semiconductor integrated circuit device according to a fourth embodiment of the invention.

FIG. 4 is a flowchart showing an optimization search function in a semiconductor integrated circuit device according to a fourth embodiment of the invention.

In the present embodiment, the LUT of the power detection compensating circuit 1D in the first embodiment is substituted for another search function means.

In FIG. 4, when the power detection compensating circuit 1D starts, STEP1 of compensating for the substrate voltage value of the PMOS is performed. STEP1 is constituted by STEP1.1 and STEP1.2.

In STEP1.1, the current output value of the operator is compared with the previous output value thereof. The output value increases by 0.1V when the previous output value is the smaller and the output value decreases by 0.1V when the previous output value is the larger. When the process is repeated, the comparison result of small-large-small or large-small-large is repeated. Therefore, STEP1.1 is ended and STEP 1.2 is performed.

Similar to STEP1.1, the current output value of the operator is compared with the previous output value in STEP1.2. In this case, the step width of the substrate supply voltage value is changed to 0.01V and the repetition process is executed.

Finally, the comparison result of small-large-small or large-small-large is repeated again. Therefore, STEP1.2 is ended and the power value is stored in a resistor. Then, STEP 2 is performed.

In STEP2, the source voltage of the semiconductor integrated circuit 1E decreases and STEP1 is performed again. The process is repeated within the range of the upper limit voltage and the lower limit voltage of the semiconductor integrated circuit and the power sum of the power supply circuit 1C and the semiconductor integrated circuit 1E is set to the minimum value.

Since the configuration of the present embodiment can be implemented by a smaller area than at the time of using the LUT, it is possible to optimize each supply voltage in consideration of the power efficiency. Finally, it becomes possible that the entire semiconductor integrated device has low power consumption in high precision. The process is sequentially performed. Accordingly, the number of loaded elements is small, thereby reducing the cost.

Application Mode

Figure 5:
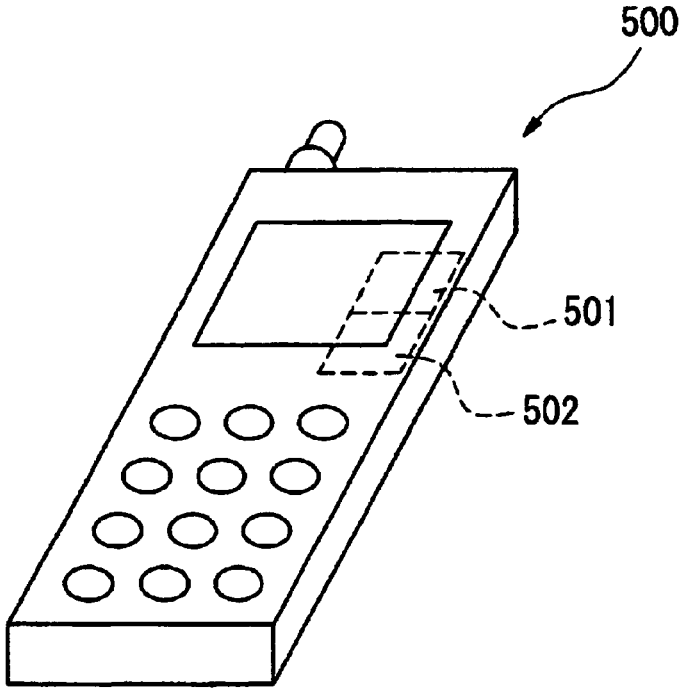
FIG. 5 shows the overview of a communication apparatus having a semiconductor integrated circuit device according to the invention.

FIG. 5 shows the overview of a communication apparatus having a semiconductor integrated circuit device according to the invention. A mobile phone 500 includes a base band LSI 501 and an application LSI 502. The base band LSI 501 and the application LSI 502 are the semiconductor integrated unit having a semiconductor integrated circuit device according to the invention. Since the semiconductor integrated circuit device according to the invention can operate with lower power consumption than the known device, the base band LSI 501, the application LSI 502, and the mobile phone 500 having the base band LSI 501 and the application LSI 502 also can operate with low power consumption. The semiconductor integrated device according to the invention is used for the logic circuit of the semiconductor integrated unit with respect to semiconductor integrated circuit units other than the base band LSI 501 and the application LSI 502, which are provided in the mobile phone 500. Accordingly, it is possible to obtain the same effect as described above.

The communication apparatus having the semiconductor integrated circuit device according to the invention is not limited to the mobile phone and a transmitter. In addition, for example, the communication apparatus includes a transmitter and a receiver or a modem apparatus for transferring data in a communication system. According to the invention, it is possible to reduce the power consumption with respect to all communication apparatuses irrespective of a wired communication and a wireless communication or an optical communication and an electrical communication and irrespective of a digital mode and an analogue mode.

Figure 6:
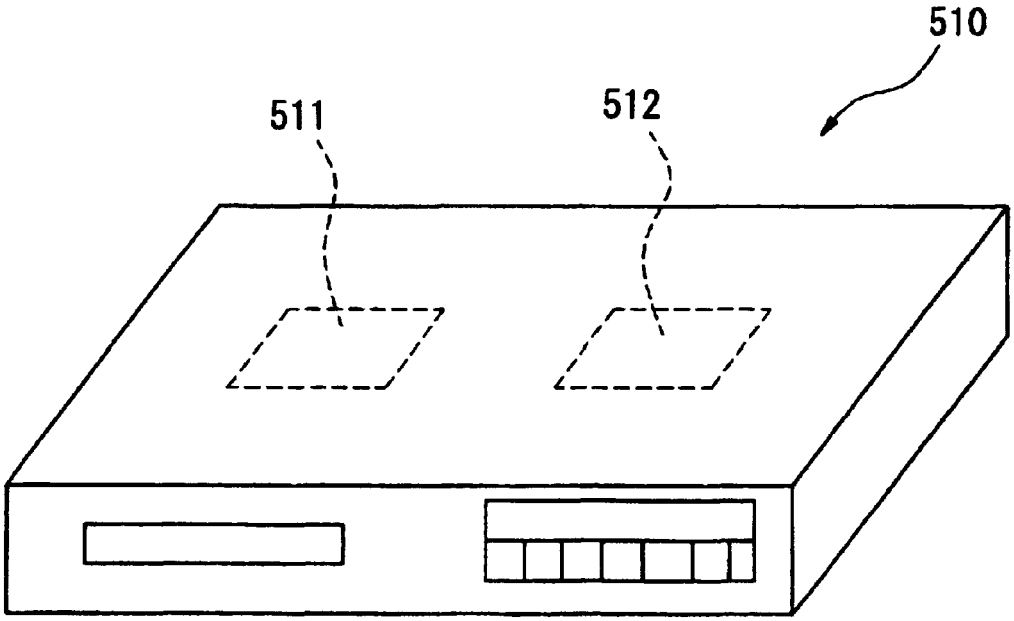
FIG. 6 shows the overview of an information reproducing apparatus having a semiconductor integrated circuit device according to the invention.

FIG. 6 shows the overview of an information reproducing apparatus having a semiconductor integrated circuit device according to the invention. An optical disk apparatus 510 includes a media signal process LSI 511 for processing a signal read from an optical disk and an error correction servo process LSI 512 for performing the servo control of an optical pickup. The media signal process LSI 511 and the error correction servo process LSI 512 are the semiconductor integrated circuit units having the semiconductor integrated circuit device according to the invention. Since the semiconductor integrated circuit device according to the invention can operate with lower power consumption than the known device, the media signal process LSI 511, the error correction servo process LSI 512, and the optical disk apparatus having the media signal process LSI 511 and the error correction servo process LSI 512 also can operate with low power consumption.

The semiconductor integrated device-according to the invention is used for the logic circuit of the semiconductor integrated unit with respect to semiconductor integrated circuit units other than the media signal process LSI 511 and the error correction servo process LSI 512, which are provided in the optical disk apparatus 510. Accordingly, it is possible to obtain the same effect as described above.

The information reproducing apparatus having the semiconductor integrated circuit device according to the invention is not limited to the optical disk device. In addition, for example, the information reproducing apparatus includes an image recording and reproducing apparatus having a magnetic disk therein or an information recording and reproducing apparatus having a semiconductor memory as the medium. That is, according to the invention, it is possible to reduce the power consumption with respect to all information reproducing apparatuses (may have an information recording function) irrespective of the media where information is recorded or not.

Figure 7:
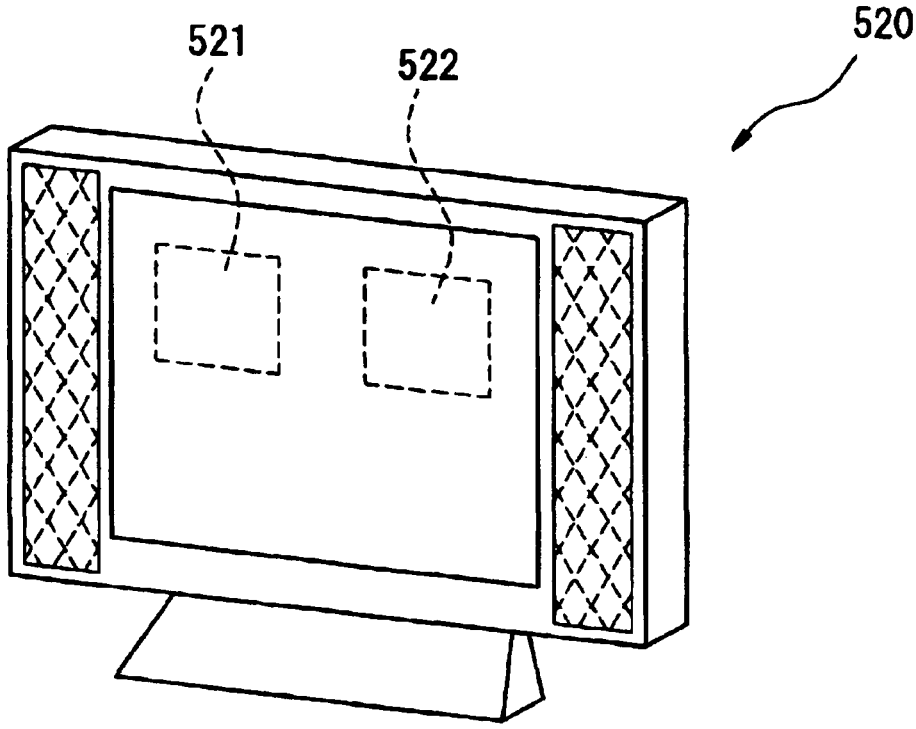
FIG. 7 shows the overview of an image display apparatus having a semiconductor integrated circuit device according to the invention.

FIG. 7 shows the overview of an image display apparatus having a semiconductor integrated circuit device according to the invention. A television receiver 520 includes an image and voice process LSI 521 for processing an image signal or a voice signal and a display and sound source control LSI 522 for controlling a device such as a display screen or a speaker. The image and sound process LSI 521 and the display and sound source control LSI 522 are the semiconductor integrated circuit unit having the semiconductor integrated device according to the invention. Since the semiconductor integrated circuit device according to the invention can operate with lower power consumption than the known device, the image and voice process LSI 521, the display and sound source control LSI 522, and the television receiver 520 also can operate with low power consumption. The semiconductor integrated device according to the invention is used for the logic circuit of the semiconductor integrated unit with respect to semiconductor integrated circuit units other than the image and voice process LSI 521 and the display and sound source control LSI 522, which are provided in the television receiver 520. Accordingly, it is possible to obtain the same effect as described above.

The image display apparatus having the semiconductor integrated circuit device according to the invention is not limited to the television receiver. In addition, for example, the image display apparatus includes an apparatus for displaying streaming data transferred via an electrical communication line. That is, it is possible to reduce the power consumption with respect to all image display apparatuses irrespective of a method of transferring information according to the invention.

Figure 8:
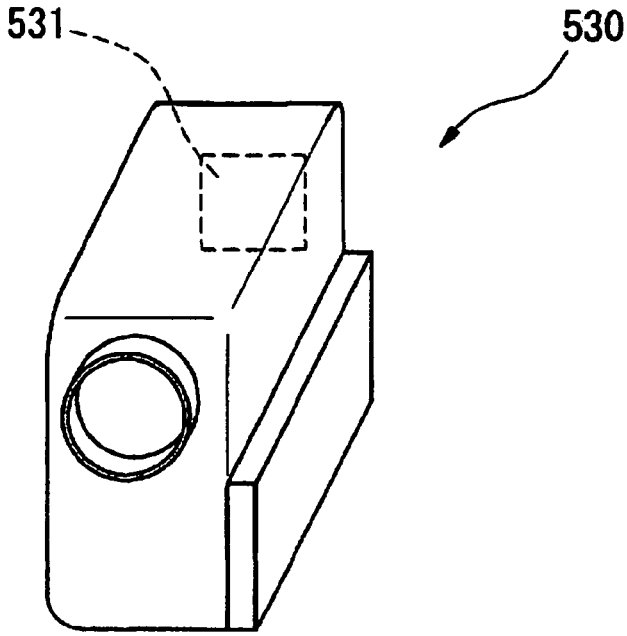
FIG. 8 shows the overview of an electronic apparatus having a semiconductor integrated circuit device according to the invention.

FIG. 8 shows the overview of an electronic apparatus having a semiconductor integrated circuit device according to the invention. A digital camera 530 includes a signal process LSI 531 which is the semiconductor integrated circuit unit having the semiconductor integrated circuit device according to the invention. Since the semiconductor integrated circuit device according to the invention can operate with lower power consumption than the known device, the signal process LSI 531 and the digital camera 530 having the signal process LSI 531 also can operate with low power consumption. The semiconductor integrated device according to the invention is used for the logic circuit of the semiconductor integrated unit with respect to semiconductor integrated circuit units other than the signal process LSI 531, which are provided in the digital camera 530. Accordingly, it is possible to obtain the same effect as described above.

The electronic apparatus having the semiconductor integrated circuit device according to the invention is not limited to the digital camera. In addition, for example, the electronic apparatus includes all apparatuses substantially having the semiconductor integrated circuit device, such as various sensor apparatus, an electronic calculator, or the like. It is possible to reduce the power consumption with respect to all electronic apparatuses according to the invention.

Figure 9:
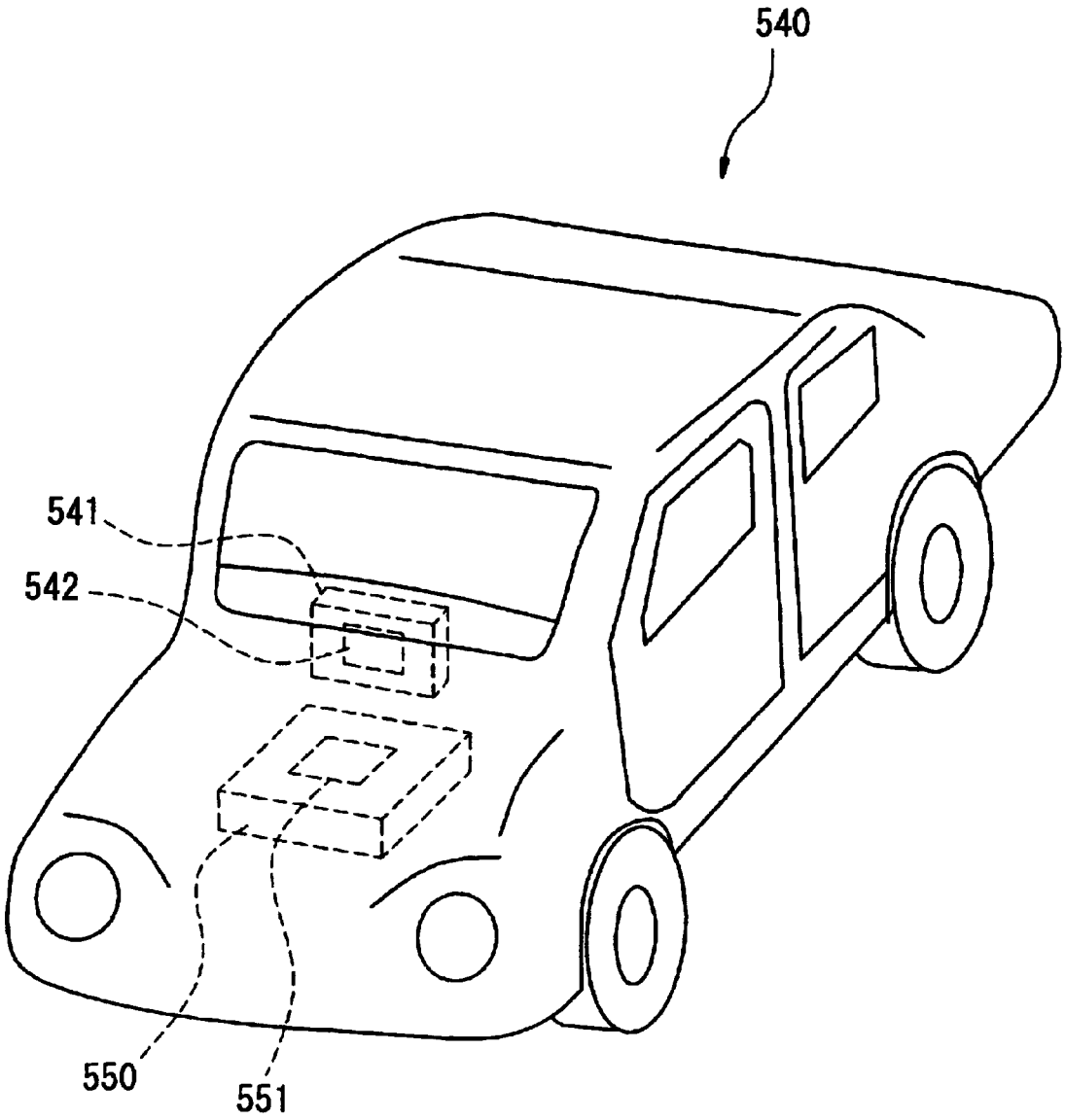
FIG. 9 shows the overview of an electronic control apparatus having a semiconductor integrated circuit device according to the invention and a movable body having the electronic control apparatus.

FIG. 9 shows the overview of an electronic control apparatus having a semiconductor integrated circuit device according to the invention and a movable body having the electronic control apparatus. A motor vehicle 540 includes an electronic control apparatus 550. The electronic control apparatus 550 is the semiconductor integrated circuit unit having the semiconductor integrated circuit device according to the invention and has an engine transmission control LSI 551 for controlling an engine or a transmission of the motor vehicle 540. In addition, the motor vehicle 540 includes a navigation apparatus 541. The navigation apparatus 541 also includes a navigation LSI 542 which is the semiconductor integrated unit having the semiconductor integrated circuit device according to the invention similar to the electronic control apparatus 550.

Since the semiconductor integrated circuit device according to the invention can operate with lower power consumption than the known device, the engine transmission control LSI 551 and the electronic control apparatus 540 having the engine transmission control LSI 551 also can operate with low power consumption. Similarly, the navigation LSI 542 and the navigation apparatus 541 having the navigation LSI 542 also can operate with low power consumption. The semiconductor integrated device according to the invention is used for the logic circuit of the semiconductor integrated unit with respect to semiconductor integrated circuit units other than the engine transmission control LSI 551, which are provided in the electronic control apparatus 550. Accordingly, it is possible to obtain the same effect as described above. The navigation apparatus 541 can be described similarly as described above. It is possible to reduce the power consumption in the motor vehicle 540 by the reduction in power consumption of the electronic control apparatus 550.

The electronic control apparatus having the semiconductor integrated circuit device according to the invention is not limited to the control of the engine or the transmission. In addition, for example, the electronic control apparatus includes all apparatuses which substantially have the semiconductor integrated circuit device, such as a motor control apparatus and controls a motivity source. According to the invention, it is possible to reduce the power consumption with respect to the electronic control apparatus.

The movable body having the semiconductor integrated circuit device according to the invention is not limited to the motor vehicle. In addition, for example, the movable body includes all apparatuses substantially having the electronic control apparatus for controlling the engine or the motor which is the motivity source, such as a trains an airplane, or the like. It is possible to reduce the power consumption with respect to the movable body according to the invention.

The invention is useful for a semiconductor integrated circuit device for a mobile application using a battery and a mobile phone or an IC card and a stationary electrical product using the semiconductor integrated circuit device.

What is claimed is:

1. A semiconductor integrated circuit device, comprising:

a power supply circuit;

a semiconductor integrated circuit;

a compensator for compensating a voltage supplied to the semiconductor integrated circuit from the power supply circuit by using a power value of the power supply circuit and a power source efficiency value of the power supply circuit; and a multiplier for multiplying the power source efficiency value in response to the power value of the power supply circuit and the output power value of the power supply circuit, wherein:

the compensator includes an operator having a function of mixing the power source efficiency value of the power supply circuit with the power value of the power supply circuit, and the operator outputs sum of the power value of the power supply circuit and a power value of the semiconductor integrated circuit.

2. The semiconductor integrated circuit device according to claim 1, wherein the multiplier multiplies a value of a resistor file which stores the power source efficiency value in response to the power value of the power supply circuit and the output power value of the power supply circuit.

3. A semiconductor integrated circuit device, comprising:

a power supply circuit;

a semiconductor integrated circuit; and a compensator for compensating a voltage supplied to the semiconductor integrated circuit from the power supply circuit by using a power value of the power supply circuit and a power source efficiency value of the power supply circuit, wherein:

the compensator includes an operator having a function of mixing the power source efficiency value of the power supply circuit with the power value of the power supply circuit and having a function of accumulating the power source efficiency value of the power supply circuit to the power value of the power supply circuit, and the operator outputs sum of the power value of the power supply circuit and a power value of the semiconductor integrated circuit, the semiconductor integrated circuit device further includes a search function unit for sequentially compensating for an output voltage value of the power supply circuit so that the output voltage value of the operator has the minimum value, wherein the search function unit roughly compensates for the output voltage value of the operator in a first step and minutely compensates for the accuracy of the output voltage value of the operator in a second step.

4. A semiconductor integrated circuit device, comprising:

a power supply circuit having a plurality of outputs;

a semiconductor integrated circuit; and a compensator for compensating a voltage supplied to the semiconductor integrated circuit from the power supply circuit by using a power value of the power supply circuit and a power source efficiency value of the power supply circuit, wherein:

the compensator includes an operator which outputs sum of the power value of the power supply circuit and a power value of the semiconductor integrated circuit, and the compensator controls the voltage of the power supply circuit so that values acquired by multiplying the power source efficiencies of the plurality of outputs of the power supply circuit by the powers supplied from the plurality of outputs of the power supply circuit are minimum values.

5. The semiconductor integrated circuit device according to claim 4, further comprising:

an accumulator for accumulating values acquired by mixing the powers supplied from the plurality of outputs of the power supply circuit with the power source efficiencies of the plurality of outputs of the power supply circuit.

6. A semiconductor integrated circuit device, comprising:

a power supply circuit having a plurality of outputs;

a semiconductor integrated circuit; and a compensator for compensating a voltage supplied to the semiconductor integrated circuit from the power supply circuit by using a power value of the power supply circuit and a power source efficiency value of the power supply circuit, wherein:

the compensator includes an operator which outputs sum of the power value of the power supply circuit and a power value of the semiconductor integrated circuit, and the compensator sequentially selects one of the outputs of the power supply circuit, fixes supply voltages of outputs other than the selected output, repeats an operation of varying the supply voltage of the selected output from the minimum voltage to the maximum voltage, and controls the voltages of the power supply circuit so that the values acquired by multiplying the power source efficiencies of the plurality of outputs of the power supply circuit by the powers supplied from the plurality of outputs of the power supply circuit are the minimum values.

7. A semiconductor integrated circuit device, comprising:

a power supply circuit;

a semiconductor integrated circuit;

a compensator for compensating a voltage supplied to the semiconductor integrated circuit from the power supply circuit by using a power value of the power supply circuit and a power source efficiency value of the power supply circuit; and a resistor file for storing the power source efficiency value in response to the output power value of the power supply circuit, wherein:

the compensator includes an operator having a function of mixing the power source efficiency value of the power supply circuit with the power value of the power supply circuit, the operator outputs sum of the power value of the power supply circuit and a power value of the semiconductor integrated circuit, and a value stored in the resistor file includes information of the power source efficiency value in response to the temperature of the power supply circuit.

8. A semiconductor integrated circuit, comprising:

a power supply circuit;

a semiconductor integrated circuit;

a compensator for compensating a voltage supplied to the semiconductor integrated circuit from the power supply circuit by using a power value of the power supply circuit and a power source efficiency value of the power supply circuit; and a resistor file for storing the power source efficiency value in response to the output power value of the power supply circuit, wherein:

the compensator includes an operator having a function of mixing the power source efficiency of the power supply circuit with the power value of the power supply circuit, the operator outputs sum of the power value of the power supply circuit and a power value of the semiconductor integrated circuit, and the value stored in the resistor file includes information of the power source efficiency value in response to the manufacturing process result of the power supply circuit.

9. A semiconductor integrated circuit device, comprising:

a power supply circuit;

a semiconductor integrated circuit; and a compensator for compensating a voltage supplied to the semiconductor integrated circuit from the power supply circuit by using a power value of the power supply circuit and a power source efficiency value of the power supply circuit, wherein:

the compensator includes an operator which outputs sum of the power value of the power supply circuit and a power value of the semiconductor integrated circuit, the compensator also uses information of activation rate of the semiconductor integrated circuit for compensating the voltage supplied to the semiconductor integrated circuit, and the compensator starts operation when the activation rate is varied.

* * * * *